US009866956B2

(12) United States Patent
Domingo Yaguez et al.

(10) Patent No.: US 9,866,956 B2
(45) **Date of Patent: *Jan. 9, 2018**

(54) MULTIPLE DEVICE NOISE REDUCTION MICROPHONE ARRAY

(71) Applicant: Intel Corporation, Santa Clara, CA (US)

(72) Inventors: Gustavo D. Domingo Yaguez, Cordova (AR); Keith L. Shippy, Tempe, AZ (US); Mark H. Price, Placitas, NM (US); Jennifer A. Healey, San Jose, CA (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/876,637

(22) Filed: Oct. 6, 2015

(65) Prior Publication Data

US 2016/0029122 A1 Jan. 28, 2016

Related U.S. Application Data

(62) Division of application No. 13/626,755, filed on Sep. 25, 2012, now Pat. No. 9,173,023.

(51) Int. Cl.

| | |
|---|---|
| ***H04R 29/00*** | (2006.01) |
| ***H04R 3/00*** | (2006.01) |
| *H04R 5/027* | (2006.01) |

(52) U.S. Cl.
CPC ..... *H04R 3/005* (2013.01); *H04R 3/002* (2013.01); *H04R 5/027* (2013.01); *H04R 29/004* (2013.01);
(Continued)

(58) Field of Classification Search
CPC ..... H04R 29/00; H04R 3/005; H04R 1/1091; H04R 2499/11; H04R 25/70;
(Continued)

(56) References Cited

U.S. PATENT DOCUMENTS 5,848,146 A * 12/1998 Slattery ..... H04M 3/56 379/388.01
6,661,901 B1 * 12/2003 Svean ..... H04R 1/1083 381/317

(Continued)

*Primary Examiner* — Lun-See Lao

(57) ABSTRACT

Various embodiments are directed to cooperation among communications devices having microphones to employ their microphones in unison to provide voice detection with noise reduction for voice communications. A first communications device comprises a processor circuit; a first microphone; an interface operative to communicatively couple the processor circuit to a network; and a storage communicatively coupled to the processor circuit and arranged to store a sequence of instructions operative on the processor circuit to store a first detected data that represents sounds detected by the first microphone; receive a second detected data via the network that represents sounds detected by a second microphone of a second communications device; subtractively sum the first and second data to create a processed data; and transmit the processed data to a third communications device. Other embodiments are described and claimed herein.

12 Claims, 9 Drawing Sheets

(52) U.S. Cl.
CPC ..... *H04R 2410/01* (2013.01); *H04R 2410/05* (2013.01); *H04R 2430/21* (2013.01); *H04R 2499/11* (2013.01)

(58) Field of Classification Search
CPC ..... H04R 1/1083; H04R 2410/05; H04R 25/305; H04R 25/554; H04R 29/004; H04R 3/02; G10K 11/178; G10K 2210/1081; G10K 11/16; G10K 11/1786; G10K 2210/3026; G10K 2210/3027; G10K 2210/3028; G10K 11/002; G10K 11/1784
USPC ..... 381/56–58, 92, 122, 72, 110, 94.1–94.5, 381/71.1–71.6, 317, 314, 71.11–71.12; 700/94; 704/233, 226–228; 379/406.01–406.06, 406.08
See application file for complete search history.

(56) References Cited

U.S. PATENT DOCUMENTS

| | | | | |
|---|---|---|---|---|
| 7,006,616 | B1 * | 2/2006 | Christofferson .... | H04L 12/1822 379/202.01 |
| 7,039,195 | B1 * | 5/2006 | Svean ..... | A61F 11/08 381/71.1 |
| 9,173,023 | B2 * | 10/2015 | Domingo Yaguez .. | H04R 3/005 |
| 9,338,301 | B2 * | 5/2016 | Pocino ..... | H04M 3/561 |
| 2010/0232632 | A1 * | 9/2010 | Kindred ..... | H04M 1/72591 381/315 |
| 2010/0272280 | A1 * | 10/2010 | Joho ..... | G10K 11/1786 381/71.6 |

* cited by examiner

1000

1000

2300

MULTIPLE DEVICE NOISE REDUCTION MICROPHONE ARRAY

CROSS-REFERENCE TO RELATED APPLICATIONS

This application is a divisional of, claims the benefit of and priority to previously filed U.S. patent application Ser. No. 13/626,755 filed Sep. 25, 2012, entitled "Multiple Device Noise Reduction Microphone Array", the subject matter of which is incorporated herein by reference in its entirety.

BACKGROUND

Communications devices employed in voice communications have long suffered from difficulties in effectively detecting voices in noisy environments. This longstanding issue has, in more recent years, become a more prevalent problem with the wide acceptance and use of mobile communications devices, such as cellular telephones. The very fact of their mobility often invites their use in noisy environments with the results that participants in a conversation are frequently asked to repeat what they've said as it becomes difficult to hear them over the background noises detected by their voice microphones along with their voices.

Various approaches have been used in trying to resolve this issue, many of which involve modifications to the design of the microphones employed as voice microphones in detecting voices to attempt to reduce their detection of unwanted noise sounds. Among such approaches have been so-called noise-canceling microphones designed to have a degree of directionality in their sensitivity to the sounds they detect, such that they tend to detect sounds emanating from a given direction to a markedly greater degree than sounds emanating from other directions. Unfortunately, such microphones can be prohibitively expensive, and are still susceptible to environmental noise sounds that by happenstance approach such microphones from the very direction in which those microphones have their greatest sensitivity.

Other approaches have sought to do away with microphones positioned in the vicinity of a speaker's mouth altogether. Among such approaches have been microphones incorporated into earpieces inserted into one or both of a speaker's ear canal in an effort to seal out environmental noises occurring outside the speaker's head, while picking up the speaker's voice as conducted via one of their Eustachian tubes and/or through bone conduction by one or more of the bones of the skull. Unfortunately, sealing the external entrance to an ear canal in this manner deprive a person of the ability to hear environmental sounds in their vicinity that they may need to hear, and can be unbearably uncomfortable for at least some people.

It is with respect to these and other considerations that the techniques described herein are needed.

DETAILED DESCRIPTION

Figure 1:
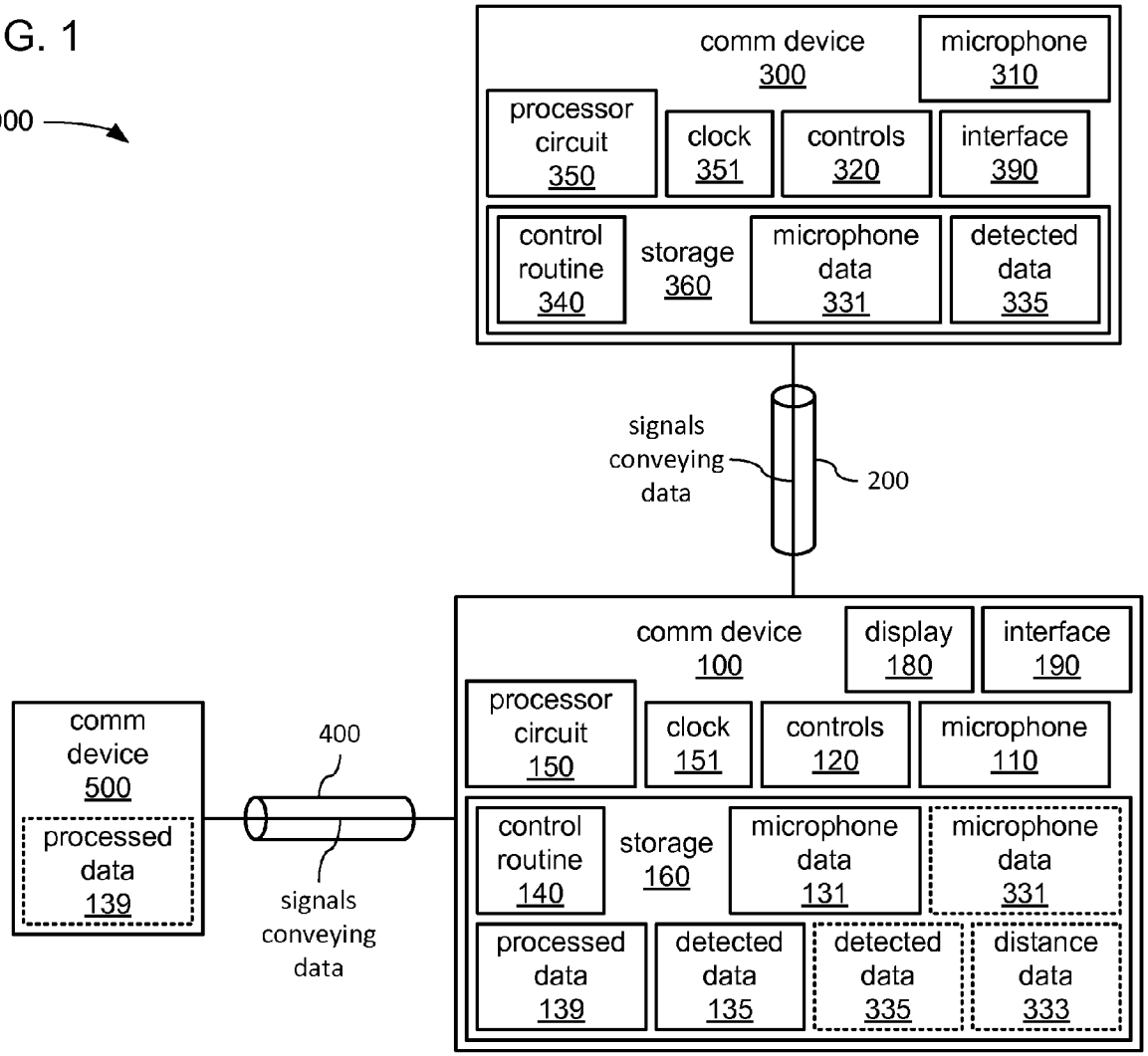
FIG. 1 illustrates a first embodiment of interaction among computing devices.

Various embodiments are generally directed to cooperation among communications devices equipped with microphones (e.g., computing devices equipped with audio components making them appropriate for use as communications devices) to employ their microphones in unison to provide voice detection with noise reduction for enhancing voice communications. Some embodiments are particularly directed to employing a microphone of one communications device as a voice microphone to detect the voice sounds of a participant in voice communications, while also employing otherwise unused microphones of other nearby and wirelessly linked communications devices as noise microphones to detect noise sounds in the vicinity of the participant for use in reducing the noise sounds that accompany the voice sounds detected by the voice microphone of the one communications device.

More specifically, it has become commonplace for a person to carry more than one communications device equipped with one or more microphones with them, and it has become commonplace to make use of only one of those microphones of only one of those communications devices as a voice microphone to detect their voice sounds when participating in voice communications. The one microphone that is so used is typically positioned in relatively close proximity to that person's mouth to more clearly detect their voice sounds, although noise sounds in the vicinity of that person are also frequently detected along with their voice sounds. Instead of allowing all of those other microphones to remain unused, one or more of those other microphones of one or more of those other communications devices may be employed as noise microphones to detect noise sounds in the vicinity of that person. It is expected that each of those other microphones will be positioned at a greater distance from that person's mouth than the one microphone selected by the person to be the voice microphone for voice communications, and therefore, the other microphones will detect more of the noise sounds and less of that person's voice sounds. The noise sounds detected by those other microphones serving as noise microphones are then employed as reference sound inputs to one or more digital filters to reduce the noise sounds accompanying the voice sounds detected by the one voice microphone.

In one embodiment, for example, a first communications device comprises a processor circuit; a first microphone; an interface operative to communicatively couple the processor circuit to a network; and a storage communicatively coupled to the processor circuit and arranged to store a sequence of instructions operative on the processor circuit to store a first detected data that represents sounds detected by the first microphone; receive a second detected data via the network that represents sounds detected by a second microphone of a second communications device; subtractively sum the first and second data to create a processed data; and transmit the processed data to a third communications device. Other embodiments are described and claimed herein.

With general reference to notations and nomenclature used herein, portions of the detailed description which follows may be presented in terms of program procedures executed on a computer or network of computers. These procedural descriptions and representations are used by those skilled in the art to most effectively convey the substance of their work to others. A procedure is here, and generally, conceived to be a self-consistent sequence of operations leading to a desired result. These operations are those requiring physical manipulations of physical quantities. Usually, though not necessarily, these quantities take the form of electrical, magnetic or optical signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to those quantities.

Further, these manipulations are often referred to in terms, such as adding or comparing, which are commonly associated with mental operations performed by a human operator. However, no such capability of a human operator is necessary, or desirable in most cases, in any of the operations described herein that form part of one or more embodiments. Rather, these operations are machine operations. Useful machines for performing operations of various embodiments include general purpose digital computers as selectively activated or configured by a computer program stored within that is written in accordance with the teachings herein, and/or include apparatus specially constructed for the required purpose. Various embodiments also relate to apparatus or systems for performing these operations. These apparatus may be specially constructed for the required purpose or may comprise a general purpose computer. The required structure for a variety of these machines will appear from the description given.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives within the scope of the claims.

FIG. 1 illustrates a block diagram of a voice communications system 1000 comprising at least communications devices 100 and 300. Each of these communications devices 100 and 300 may be any of a variety of types of computing device to which audio detection and/or output features have been added, including without limitation, a desktop computer system, a data entry terminal, a laptop computer, a netbook computer, a tablet computer, a handheld personal data assistant, a smartphone, a wireless headset, a body-worn computing device incorporated into clothing, a computing device integrated into a vehicle (e.g., a car, a bicycle, etc.), a server, a cluster of servers, a server farm, etc. As depicted, the communications devices 100 and 300 exchange signals conveying data representing digitized sounds via a link 200, and the communications device 100 also exchanges signals conveying such sound data via a link 400 with a more distant communications device 500. However, it should be noted that other data, either related or unrelated to the exchange of data representing sounds, may also be exchanged via the links 200 and 400.

Conceivably, each of the links 200 and 400 may be based on any of a variety (or combination) of communications technologies by which signals may be exchanged, including without limitation, wired technologies employing electrically and/or optically conductive cabling, and wireless technologies employing infrared, radio frequency or other forms of wireless transmission. However, it is envisioned that the link 200 is a wireless link supporting only relatively short range wireless communications, as it is envisioned that both of the communications devices 100 and 300 are used together in the possession of a common user either on or in close proximity to their person. It is also envisioned that the link 400 is either a wired or wireless link supporting relatively long range communications, as it is envisioned that the communications device 500 is either in the possession of another person with whom the user of the communications devices 100 and 300 is engaged in voice communications, or that the communications device 500 is a relay device extending the range of the voice communications still further towards that other person.

Thus, the communications devices 100 and 300 are caused to cooperate via the link 200 as they are employed by a common user to engage in voice communications with another person. Such cooperation may be caused by that common user by configuring each of these communications to cooperate with the other in enabling the user to employ them together in engaging in voice communications. Such configuration may occur as the common user of both of these communications devices employs one or more procedures to first configure each to signal the other through the link 200 (a process sometimes referred to as "pairing"), and then configure each to exchange sound data with the other as described herein. Depending on the nature of the communications technology and/or protocols of the link 200, this configuration of both of the communications devices 100 and 300 may have the quality of "persistence" insofar as such configuration need take place only once for these two communications devices to recognize each other and become operable together.

A microphone 310 of the communications device 300 is disposed in the vicinity of the user's mouth to serve as a voice microphone to detect their voice sounds, while a microphone 110 of the communications device 100 is positioned elsewhere in the vicinity of the user to serve as a noise microphone to detect noise sounds in the vicinity of the user. It is expected that, despite whatever noise reduction technologies are employed in the design of the microphone 310, the microphone 310 will still likely detect some amount of noise sounds in the vicinity of the user along with their voice sounds. Employing analog-to-digital any of a variety of conversion technologies, the sounds detected by each of the microphones 110 and 310 are converted to data representing their respective detected sounds in digital form. Following such conversion, the digital data representing the sounds (both voice sounds and accompanying noise sounds) detected by the microphone 310 is transmitted via the link 200 from the communications device 300 to the communications device 100. Within the communications device 100, the noise sounds detected by the microphone 110 are employed to reduce the noise sounds detected by the microphone 310 along with the user's voice. The processed sounds that result are then transmitted by the communications device 100 via the link 400 to the more distantly located communications device 500.

In various embodiments, the communications device 100 comprises the microphone 110, a storage 160, a processor circuit 150, a clock 151, controls 120, a display 180, and an interface 190 coupling the communications device 100 variously to the communications devices 300 and 500 via the links 200 and 400, respectively. The storage 160 stores therein a control routine 140, microphone data 131 and 331, distance data 333, detected data 135 and 335, and processed data 139. It is envisioned that the communications device 100 is likely a stationary wired telephone, a cellular telephone, a walkie talkie, a two-radio or other similar form of communications device.

In various embodiments, the communications device 300 comprises the microphone 310, a storage 360, a processor circuit 350, a clock 351, controls 320, and an interface 390 coupling the communications device 300 to the communications device 100 via the link 200. The storage 360 stores therein a control routine 340, the microphone data 331 and the detected data 335. It is envisioned that the communications device 300 is likely a wireless headset meant to be used as an accessory in conjunction with the communications device 100, possibly to provide "hands-free" voice communications and/or to at least eliminate the need to use a handset or microphone tethered by a cable to the communications device 100.

In executing a sequence of instructions of at least the control routine 140, the processor circuit 150 is caused to employ the controls 120 and the display 180 in providing a user interface to the user of the communications devices 100 and 300 that enables the user to operate the communications device 100 to engage in voice communications. The processor circuit 150 is caused to await a signal conveying a command to begin voice communications. This signal may be received either relatively directly from the controls 120 as a result of their being operated, or via the link 200 indicating operation of the controls 320. Operation of one or the other of the controls 120 or 320 may include a selection of a radio frequency, a dialing of a phone number, a press of a button to cause an incoming telephone call to be answered, a voice command to initiate or answer a telephone call, etc. Upon receipt of such a signal, the processor circuit 150 is caused to operate the interface 190 to support exchanges of sound data with the communications devices 300 and 500 via the links 200 and 400, respectively. Correspondingly, the processor circuit 350 is caused to operate the interface 390 to support exchanges of sound data with the communications device 100.

Regardless of the exact manner in which the communications devices 100 and 300 are signaled to cooperate with each other to enable their common user to engage in voice communications, the processor circuit 350 is caused to monitor the microphone 310 and to buffer voice sounds detected by the microphone 310 (in its role as a voice microphone) in the storage 360 as the detected data 335. As will be familiar to those skilled in the art, the microphone 310 outputs an analog electric signal corresponding to the sounds that it detects, and any of a variety of possible analog-to-digital signal conversion technologies may be employed to enable the electric signal output of the microphone 310 to be converted into the detected data 335 that digitally represents the voice sounds (and accompanying noise sounds) detected by the microphone 310. Correspondingly, the processor circuit 150 is caused to monitor the microphone 110 and to buffer environmental noise sounds detected by the microphone 110 (in its role as a noise microphone) in the storage 160 as the detected data 135. Again, any of a variety of possible analog-to-digital signal conversion technologies may be employed to enable the electric signal output of the microphone 110 to be converted into the detected data 135 that digitally represents the noise sounds detected by the microphone 110.

The processor circuit 350 is caused to recurringly transmit the detected data 335 via the link 200 to the communications device 100, where the processor circuit 150 is caused to recurringly store it in the storage 160. With the sounds detected by both of the microphones 110 and 310 buffered within the storage 160, the processor circuit 150 is caused to recurringly subtractively sum the sounds detected by both microphones in a manner in which there is destructive addition of the noise sounds detected by both microphones to reduce the noise sounds detected along with voice sounds by the 310 as represented in the detected data 335. The result of this subtractive summation is recurringly stored by the processor circuit 150 in the storage 160 as the processed data 139, which represents the voice sounds detected by the microphone 310 with the noise sounds also detected by the microphone 310 reduced to enable the voice sounds to be heard more easily. The processor circuit 150 is further caused to recurringly operate the interface 190 to transmit the processed data 139 to the communications device 500 via the link 400.

It should be noted that in two-way audio communications, the communications device 100 would be expected to also receive data from the distant communications device 500 representing voice sounds of another person with whom the user of the communications devices 100 and 300 is engaged in voice communications, and that the communications device 100 would relay that received data to the communications device 300 to convert into audio output to at least one of the user's ears. However, for the sake of clarity of discussion and figures presented herein, this receipt and audio output of data representing voice sounds from the communications device 500, thereby representing the other half of two-way voice communications, is not depicted or discussed herein in detail.

Effective use of destructive addition of two sounds to reduce a noise in one of those sounds using a noise in the other requires signal processing of at least one of the noises to adjust its amplitude, phase and/or other characteristic relative to the other. Stated differently, at least one of the two sounds most likely must be subjected to a transfer function that at least alters amplitude and/or phase before subtractively summing it with the other. Defining such a transfer function requires some understanding of various physical parameters related to the sounds, themselves, and/or to how those sounds are detected and stored.

As will also be familiar to those skilled in the art, aspects of the detection of noise sounds are unavoidably influenced by characteristics of the microphone(s) used to detect them. Therefore, in support of defining one or more transfer functions employed in reducing the noise sounds detected along with voice sounds by the microphone 310, the processor circuit 350 is caused to transmit the microphone data 331 via the link 200 to the communications device 100, where the processor circuit 150 stores the received microphone data 331 in the storage 160 along with the microphone data 131. The microphone data 131 and the microphone data 331 describe the frequency responses and/or other characteristics of the microphones 110 and 310, respectively, allowing differences between them to be taken into account as a basis of defining one or more transfer functions.

When destructively combining noise sounds detected by different microphones positioned at different locations in a subtractive summation intended to reduce noise sound levels, the distance between the different microphones may become significant in aligning the phases of the different noise sounds to achieve a subtractive summation and avoid an additive summation, especially at higher frequencies. Therefore, in support of defining one or more transfer functions employed in reducing the noise sounds detected along with voice sounds by the microphone 310, the processor circuit 350 is caused to recurringly determine the distance between the microphones 110 and 310, and to store that determined distance in the storage 160 as the distance data 333. In some embodiments, where the technology, signaling characteristics and/or protocols employed in forming the link 200 permit tests to determine a distance between two devices at opposite ends of such a link, the processor circuit 150 (perhaps with cooperation of the processor circuit 350) operates the interface 190 to vary signal strength and/or to employ other techniques to determine the distance between the communications devices 100 and 300. In other embodiments, the processor circuit 150 is caused to operate a speaker (not shown) of the communications device 100 to recurringly emit a test sound and the processor circuit 350 is caused to monitor the microphone 310 to detect the times at which the microphone 310 detects each emission of the test sound. As those skilled in the art will readily recognize, it may be possible to operate the microphone 110 to emit the test sounds in lieu of operating a speaker to do so. A speed at which sound typically travels through the atmosphere at one or more altitudes is then employed to calculate the distance between the microphone 310 and whatever component of the communications device 100 emitted the test sound. It is envisioned that the test sound will have a frequency outside a typical range of frequencies of human hearing to avoid disturbing the user or other persons.

Depending on the exact physical configurations of each of the communications devices and/or the manner in which they may be carried about and used by their common user, the distance between the microphones 110 and 310 may be apt to change throughout the duration of a typical instance of voice communications. To address this, in various embodiments, the processor circuits 150 and/or 350 may be caused to recurringly perform one or more tests to recurringly determine the distance between the microphones 110 and 310, thus recurringly updating the distance data 333. In such embodiments, whatever transfer function(s) are employed to reduce the noise sounds detected along with voice sound by the microphone 310 may also be recurringly updated. Alternatively or additionally, a weighting function may be applied to the noise sounds detected by the microphone 110 in which greater use is made of those noise sounds when the microphones 110 and 310 are closer together, and lesser use is made of those noise sounds when the microphones 110 and 310 are further apart. The weighting factor may vary the amplitude of the noise sounds detected by the microphone 110, may alter the manner in which the subtractive summing is implemented, or may vary one or more parameters of the transfer function to which the noise sounds detected by the microphone 110 is subjected.

This is in recognition of the fact that, generally, two microphones located in relatively close proximity to each other and acoustically exposed to the same acoustic environment will generally detect relatively similar sounds. In contrast, generally, two microphones located relatively far apart from each other, despite being acoustically exposed to the same environment, will be more likely to detect sounds that are more dissimilar, even where the source of all of the sounds detected by both microphones is the same. As those skilled in the art will readily recognize, the acoustic power of a given sound from a given source drops exponentially as the distance from that source increases. Thus, where two microphones detecting sounds from the same source are located relatively far apart, it may be that one of them detects the same sounds at a considerably different amplitude than the other, a situation that can usually be compensated for. It may also be that the acoustic environments in the vicinities of two widely separated microphones are sufficiently acoustically different that the sounds from the same source are subjected to considerable echoing in the vicinity of one of the microphones while those same are subjected to greater absorption in the vicinity of the other microphone. Thus, where two microphones a positioned further apart, the sounds detected by one may be more unrelated to the sounds detected by the other than they would be if the two microphones were closer together.

Although distance between the microphones 110 and 310 may be a factor in each detecting what may become very different noise sounds, other factors including degree of directionality of one or both of these microphones, placement of one of the communications devices 100 or 300 inside an acoustically dissimilar environment (e.g., inside a backpack, briefcase, coat pocket, etc.), or subjecting one of the communications devices 100 or 300 to a dissimilar vibratory environment (e.g., carrying one of them on a part of the user's body that subjects it to considerably greater vibration from jogging) may result in the microphones 110 and 310 detecting sounds that are highly dissimilar. The processor circuit 350 may be further caused to recurringly compare the sounds detected by the microphones 110 and 310, and to recurringly determine the degree of difference between them. In response to the difference exceeding a threshold selected to make allowance for the degree of difference resulting from the user's voice sounds being more prevalent in what is detected by one microphone than by the other, a weighting factor may be applied to the noise sounds detected by the microphone 110 that reduces its use in reducing the noise sounds detected by the microphone 310 (along with the user's voice sounds).

Propagation delay between the time a sound is detected by the microphone 310 and the time the sound is received by the communications device 100 may be lengthy and/or difficult to predict based on various factors, including the processing abilities of the processor circuit 350, characteristics of any buffering or packetizing of data before it is transmitted via the link 200, the manner in which resending of data in response to data errors is handled, etc. As those skilled in the art will readily recognize, for the noise sounds represented in the detected data 135 to be effectively used in reducing noise sounds represented in the detected data 335, they must be temporally aligned. Otherwise, instead of noise reduction, the net effect would likely be an overall increase in noise sounds. To enable temporal alignment of the detected data 135 and 335, the communications devices 100 and 300 may cooperate via the network 999 to synchronize the clocks 151 and 351, respectively. Following this synchronization, the detected data 135 and 335 may be recurringly timestamped as each is stored in the storages 160 and 360, respectively. Upon being received by the communications device 100 from the communications device 300, the timestamping of each of the detected data 135 and 335 is used to effect their temporal alignment.

Alternatively and/or additionally, to enable temporal alignment of the detected data 135 and 335, the processor circuit 350 may be caused to recurringly align the detected data 135 and 335 through comparisons of the content of the sounds detected by each of the microphones 110 and 310 (as represented by the detected data 135 and 335) to detect one or more relatively distinguishable acoustic features (e.g., an onset or end of a relatively distinct sound) in those sounds within up to a few seconds (e.g., possibly up to 5 seconds) of skew. From such comparisons, the amount of such a skew in time (e.g., temporal difference) between where a distinguishable acoustic feature is represented in the detected data 135 versus where it is represented in the detected data 335 is determined, and then employed in temporally aligning the detected data 135 and 335. Indeed, recurring emission of the earlier-described test sound may be employed to provide a distinguishable acoustic feature of known characteristics for use in detecting such a difference in time.

One or more of the transmission of the microphone data 331 to the communications device 100, the synchronization of the clocks 151 and 351, the determination of a skew in time, etc. may be performed at an earlier time at which the communications devices 100 and 300 are configured to communicate with each other (e.g., during "pairing" of communications devices), or in response to the start of voice communications.

As previously discussed, each of the communications devices 100 and 300 are functionally computing devices augmented with audio features (e.g., the microphones 110 and 310, and the ability to exchange sound data) to render them appropriate for use as communications devices.

In various embodiments, each of the processor circuits 150 and 350 may comprise any of a wide variety of commercially available processors, including without limitation, an AMD® Athlon®, Duron® or Opteron® processor; an ARM® application, embedded or secure processor; an IBM® and/or Motorola® DragonBall® or PowerPC® processor; an IBM and/or Sony® Cell processor; or an Intel® Celeron®, Core (2) Duo®, Core (2) Quad®, Core i3®, Core i5®, Core i7®, Atom®, Itanium®, Pentium®, Xeon® or XScale® processor. Further, one or more of these processor circuits may comprise a multi-core processor (whether the multiple cores coexist on the same or separate dies), and/or a multi-processor architecture of some other variety by which multiple physically separate processors are in some way linked.

In various embodiments, each of the storages 160 and 360 may be based on any of a wide variety of information storage technologies, possibly including volatile technologies requiring the uninterrupted provision of electric power, and possibly including technologies entailing the use of machine-readable storage media that may or may not be removable. Thus, each of these storages may comprise any of a wide variety of types (or combination of types) of storage device, including without limitation, read-only memory (ROM), random-access memory (RAM), dynamic RAM (DRAM), Double-Data-Rate DRAM (DDR-DRAM), synchronous DRAM (SDRAM), static RAM (SRAM), programmable ROM (PROM), erasable programmable ROM (EPROM), electrically erasable programmable ROM (EEPROM), flash memory, polymer memory (e.g., ferroelectric polymer memory), ovonic memory, phase change or ferroelectric memory, silicon-oxide-nitride-oxide-silicon (SONOS) memory, magnetic or optical cards, one or more individual ferromagnetic disk drives, or a plurality of storage devices organized into one or more arrays (e.g., multiple ferromagnetic disk drives organized into a Redundant Array of Independent Disks array, or RAID array). It should be noted that although each of these storages is depicted as a single block, one or more of these may comprise multiple storage devices that may be based on differing storage technologies. Thus, for example, one or more of each of these depicted storages may represent a combination of an optical drive or flash memory card reader by which programs and/or data may be stored and conveyed on some form of machine-readable storage media, a ferromagnetic disk drive to store programs and/or data locally for a relatively extended period, and one or more volatile solid state memory devices enabling relatively quick access to programs and/or data (e.g., SRAM or DRAM). It should also be noted that each of these storages may be made up of multiple storage components based on identical storage technology, but which may be maintained separately as a result of specialization in use (e.g., some DRAM devices employed as a main storage while other DRAM devices employed as a distinct frame buffer of a graphics controller).

In various embodiments, each of the interfaces 190 and 390 may employ any of a wide variety of signaling technologies enabling each of the computing devices 100, 300 and 500 to be coupled through the links 200 and 400 as has been described. Each of these interfaces comprises circuitry providing at least some of the requisite functionality to enable such coupling. However, each of these interfaces may also be at least partially implemented with sequences of instructions executed by corresponding ones of the processor circuits 150 and 350 (e.g., to implement a protocol stack or other features). Where one or more of the links 200 and 400 employs electrically and/or optically conductive cabling, one or more of the interfaces 190 and 390 may employ signaling and/or protocols conforming to any of a variety of industry standards, including without limitation, RS-232C, RS-422, USB, Ethernet (IEEE-802.3) or IEEE-1394. Alternatively or additionally, where one or more portions of the links 200 and 400 employs wireless signal transmission, one or more of the interfaces 190 and 390 may employ signaling and/or protocols conforming to any of a variety of industry standards, including without limitation, IEEE 802.11a, 802.11b, 802.11g, 802.16, 802.20 (commonly referred to as "Mobile Broadband Wireless Access"); Bluetooth; ZigBee; or a cellular radiotelephone service such as GSM with General Packet Radio Service (GSM/GPRS), CDMA/1×RTT, Enhanced Data Rates for Global Evolution (EDGE), Evolution Data Only/Optimized (EV-DO), Evolution For Data and Voice (EV-DV), High Speed Downlink Packet Access (HSDPA), High Speed Uplink Packet Access (HSUPA), 4G LTE, etc. It should be noted that although each of the interfaces 190 and 390 are depicted as a single block, one or more of these interfaces may comprise multiple interface components that may be based on differing signaling technologies. This may be the case especially where one or more of these interfaces couples corresponding ones of the computing devices 100 and 300 to more than one network, each employing differing communications technologies.

In various embodiments, each of the controls 120 and 320 may comprise any of a variety of types of manually-operable controls, including without limitation, lever, rocker, push-button or other types of switches; rotary, sliding or other types of variable controls; touch sensors, proximity sensors, heat sensors, bioelectric sensors, at touch surface or touch-screen enabling use of various gestures with fingertips, etc. These controls may comprise manually-operable controls disposed upon a casing of corresponding ones of the computing devices 100 and 300, and/or may comprise manually-operable controls disposed on a separate casing of a physically separate component of corresponding ones of these computing devices (e.g., a remote control coupled to other components via infrared signaling). Alternatively or additionally, these controls may comprise any of a variety of non-tactile user input components, including without limitation, a microphone by which sounds may be detected to enable recognition of a verbal command; a camera through which a face or facial expression may be recognized; an accelerometer by which direction, speed, force, acceleration and/or other characteristics of movement may be detected to enable recognition of a gesture; etc.

In various embodiments, the display 180 may be based on any of a variety of display technologies, including without limitation, a liquid crystal display (LCD), including touch-sensitive, color, and thin-film transistor (TFT) LCD; a plasma display; a light emitting diode (LED) display; an organic light emitting diode (OLED) display; a cathode ray tube (CRT) display, etc. The display 180 may be disposed on a casing of the computing device 100, or may be disposed on a separate casing of a physically separate component (e.g., a flat panel monitor coupled to other components via cabling).

In various embodiments, each of the microphones 110 and 310 may be any of a variety of types of microphone based on any of a variety of sound detection technologies, including and not limited to, electret microphones, dynamic microphones, carbon-type microphones, piezoelectric elements, etc. Each of the microphones 110 and 310 is disposed on a casing of respective ones of the communications devices 100 and 300 in a manner that acoustically couples each to ambient air environments. When used together as described herein, each of the microphones is apt to detect the same noise sounds in the environment in the vicinity of the common user of the communications devices 100 and 300, but their somewhat different locations necessarily results in at least slight differences in the noise sounds that each detects. Further, as has been discussed, it is expected that one of these microphones will be selected by the user for voice communications and will, therefore, be positioned more close to the user's mouth than the other such that a greater proportion of the sounds that it detects will be voice sounds of the user, while those voice sounds will be a lesser proportion of what the other detects.

In various embodiments, the clocks 151 and 351 may be based on any of a variety of timekeeping technologies, including analog and/or digital electronics, such as an oscillator, a phase-locked loop (PLL), etc. One or both of the clocks 151 and 351 may be provided with an electric power source separate from other components of the computing devices 100 and 300, respectively, to continue to keep time as other components are powered off.

Figure 2:
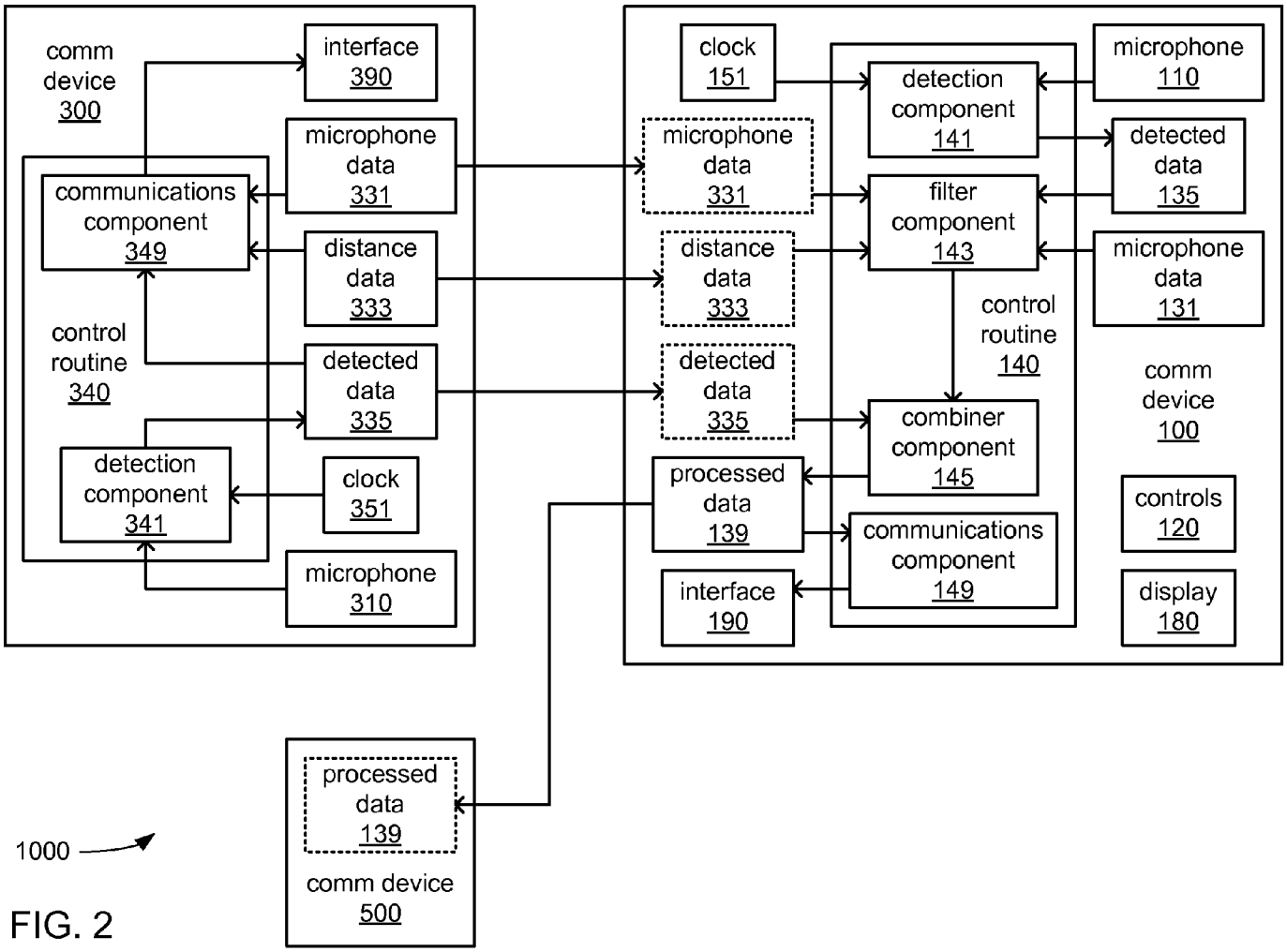
FIG. 2 illustrates a portion of the embodiment of FIG. 1.

FIG. 2 illustrates a block diagram of a portion of the block diagram of FIG. 1 in greater detail. More specifically, aspects of the operating environments of the communications devices 100 and 300, in which their respective processor circuits 150 and 350 (shown in FIG. 1) are caused by execution of their respective control routines 140 and 340 to perform the aforedescribed functions are depicted. As will be recognized by those skilled in the art, each of the control routines 140 and 340, including the components of which each is composed, are selected to be operative on whatever type of processor or processors that are selected to implement each of the processor circuits 150 and 350.

In various embodiments, one or more of the control routines 140 and 340 may comprise a combination of an operating system, device drivers and/or application-level routines (e.g., so-called "software suites" provided on removable storage media, individual "apps" or applications, "applets" obtained from a remote server, etc.). Where an operating system is included, the operating system may be any of a variety of available operating systems appropriate for whatever corresponding ones of the processor circuits 150 and 350, including without limitation, Windows™, OS X™, Linux®, or Android OS™. Where one or more device drivers are included, those device drivers may provide support for any of a variety of other components, whether hardware or software components, that comprise one or more of the computing devices 100 and 300.

Each of the control routines 140 and 340 comprises a communications component 149 and 349, respectively, executable by corresponding ones of the processor circuits 150 and 350 to operate corresponding ones of the interfaces 190 and 390 to transmit and receive signals variously via the links 200 and 400 as has been described. As will be recognized by those skilled in the art, each of the communications components 149 and 349 are selected to be operable with whatever type of interface technology is selected to implement each of the interfaces 190 and 390.

Each of the control routines 140 and 340 comprises a detection component 141 and 341, respectively, executable by corresponding ones of the processor circuits 150 and 350 to receive the analog signal outputs of the microphones 110 and 310, employ any of a variety of appropriate analog-to-digital conversion technologies (possibly in the form of discrete A-to-D converters, A-to-D converters incorporated into the processor circuits 100 and 300, etc.) to convert their analog outputs into sound data representing digitized forms of the sounds detected by the microphones 110 and 310, and buffer that sound data as the detected data 135 and 335, respectively. In so doing, where timestamps are employed to temporally align the detected data 135 and 335, the detected data 135 and 335 may each be recurringly timestamped within the communications device 100 and 300 using indications of current time provided by the clocks 151 and 351, respectively. In support of such timestamping, the clocks 151 and 351 may be synchronized prior to such timestamping.

In one possible approach to processing at least one of the detected data 135 and 335 for use as an input in subtractive summing, the control routine 140 comprises a filter component 143 executable by the processor circuit 150 to subject the detected data 135 representing the noise sounds detected by the microphone 110 in its role as a noise microphone to a transfer function derived by the processor circuit 150 to alter amplitude, phase and/or other characteristics of those noise sounds. As has been discussed, the transfer function implemented by the filter component 143 may be derived based on one or more of the microphone data 131, the microphone data 331 and the distance data 333. As has been discussed, the microphone data 331 and the distance data 333 may be provided by the communications device 300 to the communications device 100 via the link 200 at an earlier time when these two communications devices are configured to communicate with each other and/or in response to instances of these communications devices being used together as described herein for voice communications.

The control routine 140 comprises a combiner component 145 executable by the processor circuit 150 to subtractively sum the detected data 135, as altered by the filter component 143, and the detected data 335 to derive the processed data 139. In so doing, noise sounds detected by the microphone 310 along with voice sounds of the user are reduced using the noise sounds detected by the microphone 110, as altered by the transfer function implemented by the filter component 143. The combiner component 145 may implement the earlier discussed application of a weighting factor to the detected data 135 to alter the degree to which it is used in subtractive summation to reduce noise sounds represented in the detected data 335 as a result of various circumstances, such as and not limited to, a relatively great distance between the microphones 110 and 310, or a degree of dissimilarity between the sounds detected by each that exceeds a selected threshold. Further, the monitoring of the detected data 135 and 335 to detect relatively distinguishable features that may be used to determine a temporal skew and the use of such distinguishable features in aiding temporal alignment of the data 135 and 335 may be implemented by the combiner component 145.

In one example of the voice communications system 1000 of FIG. 1, the communications device 100 is a telephone (either cellular or corded) and the communications device 300 is a wireless headset used as an accessory to the communications device 100 by a common user of both of these communications devices. At an earlier time, this user put these two communications devices through a pairing procedure (as will be familiar to those skilled in the art of such wireless networking procedures) to configure them to establish the link 200 therebetween and to wirelessly communicate with each other via that link.

Upon arriving at a picnic table in a park, the user sets the communications device 100 on the picnic table, operates the controls 120 to dial a phone number, and inserts the communications device 300 into an ear canal of one ear to secure it in place in preparation for using the microphone 310 in voice communications with the person associated with the phone number. Such operation of the controls 120 triggers the communications device 100 to signal the communications device 300 to cooperate in supporting their common user in engaging in voice communications. As previously discussed, signals may be exchanged via the network 999 to convey the microphone data 331 to the communications device 100 and/or to cause these two communications devices to synchronize their clocks 151 and 351 at the start of these voice communications, or at the earlier time when they were being configured.

Thus, the microphone 310 is employed as the voice microphone, becoming the primary microphone for detecting the user's voice sounds, and the microphone 110 is employed as a noise microphone for detecting noise sounds in the environment in which the communications devices 100 and 300 currently exist, but with less exposure to the user's voice sounds. The communications device 300 recurringly transmits the detected data 335 to the communications device 100. Thus, noise sounds detected by the microphone 110 are employed, as has been described at length, to reduce the noise sounds that are detected by the microphone 310 along with the user's voice sounds so that the user's voice sounds, as transmitted to the communications device 500, are easier to hear.

While the phone call is underway, the user paces about in the general vicinity of the picnic table, getting closer to and further away from it at various times, and thereby repeatedly altering the distance between the microphones 110 and 310. In pacing about, as the user walks further away from the picnic table, the noise sounds detected by the microphone 310 start to differ to a greater degree from the noise sounds detected by the microphone 110. It may be, for example, that there are children playing nearby, and as the user walks more in their direction from the picnic table, the microphone 310 detects more of the noise sounds of the children playing than does the microphone 110. It may be, for example, that someone is driving their car into a nearby parking lot that is relatively close to the picnic table such that as the user paces about further from the picnic table the microphone 110 detects more of that car's engine noises than does the microphone 310. Thus, more generally, as the user paces away from the picnic table, the noise sounds detected by the microphones 110 and 310 bear less of a connection to each other.

In anticipation of such situations, the communications devices 100 and 300 cooperate to recurringly determine the distance between the microphones 110 and 310, and to adjust a weighting applied to the noise sounds detected by the microphone 110, accordingly. As the user paces away from the picnic table, the increased distance is detected and the sounds detected by the microphone 110 are relied upon to a lesser degree in reducing the noise sounds detected by the microphone 310.

As has been discussed, the distance between the microphones 110 and 310 may be recurringly tested through recurring use of tests of signal strength in the wireless transmissions between the communications devices 100 and 300 that enable the provision of the link 200. Alternatively, a speaker, microphone or other form of electro-acoustic transducer of one of the communications devices 100 or 300 may be employed to emit a test sound that the other of the communications devices 100 or 300 employ the microphone 110 or 310, respectively, to detect. As it is possible that the user could have paced a sufficient distance away from the picnic table that the test sound can no longer be detected, it may be that a weighting value may be selected in selected in such instances that results in the noise sounds detected by the microphone 110 no longer being used, at all.

Alternatively or additionally, the sounds detected by the microphones 110 and 310 may be monitored to recurringly determine the degree to which they differ in comparison to a selected threshold of difference. The threshold is selected to allow for the degree of difference expected to result from the different roles that each of these microphones 110 and 310 play in which one detects the voice of the user to a greater degree than the other. As long as this difference is recurringly determined to be below the threshold, then the sounds detected by the microphone 110 may be used to a greater degree, whereas if the threshold is exceeded, then those sounds may be used to a lesser degree (possibly not at all). Thus, if the car's engine noises in the vicinity of the communications device 100 on the picnic table create enough of a degree of difference, then the sounds detected by the microphone 110 in its role as a noise microphone may not be used.

Figure 3:
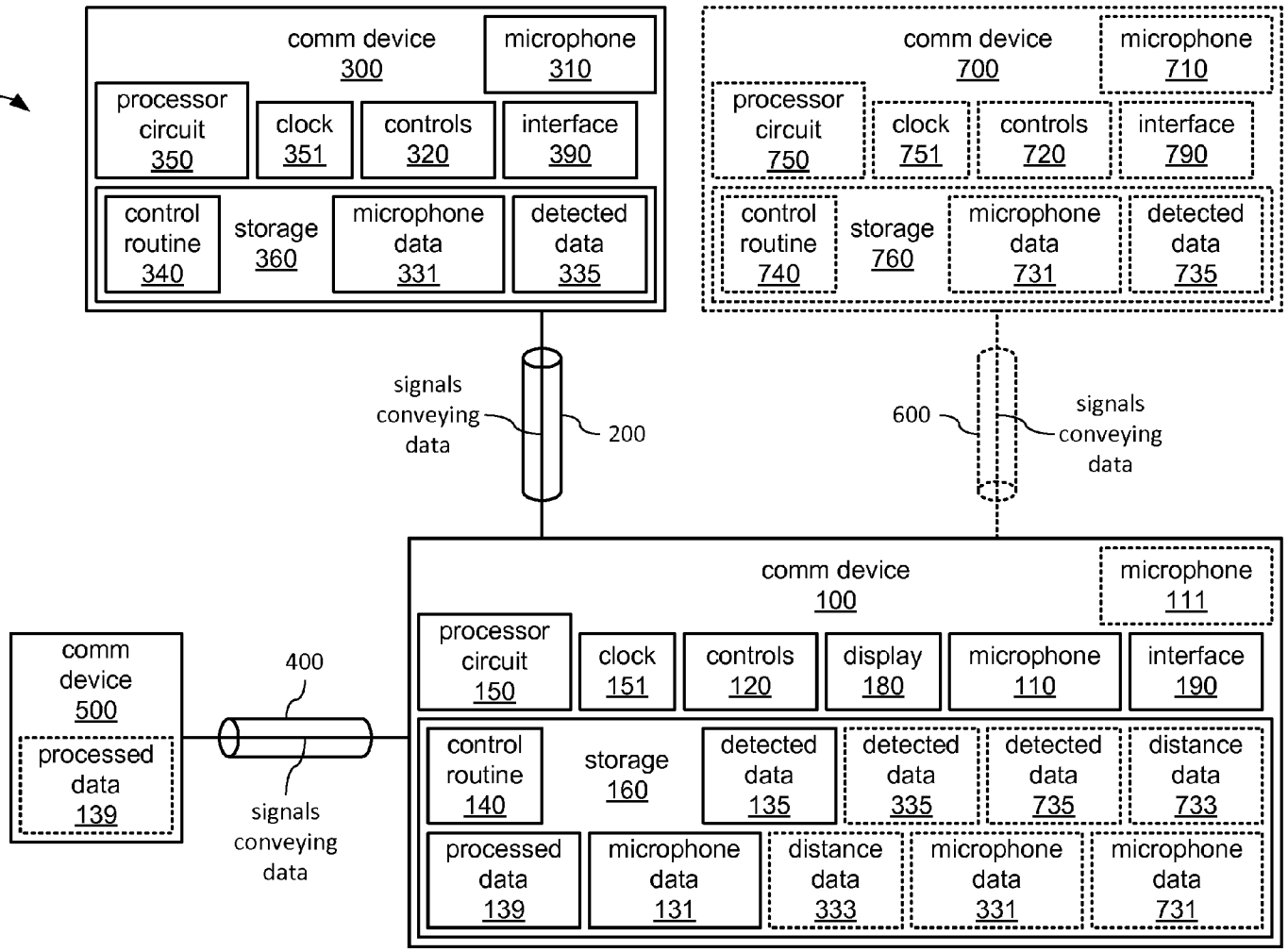
FIG. 3 illustrates a second embodiment of interaction among computing devices.

FIG. 3 illustrates a block diagram of a variation of the voice communications system 1000 of FIG. 1. This variation depicted of FIG. 3 is similar to what is depicted in FIG. 1 in many ways, and thus, like reference numerals are used to refer to like elements throughout. However, unlike the variant of the voice communications system 1000 of FIG. 1, in the variant of the voice communications system 1000 of FIG. 3, the roles of the microphones 110 and 310 are reversed such that the microphone 110 is employed as the voice microphone used primarily to detect voice sounds, while the microphone 310 is employed as a noise microphone to detect noise sounds. Thus, while the communications devices 100 and 300 still communicate via the link 200, the detected data 335 sent by the communications device 300 to the communications device 100 now represents noise data detected by the microphone 310 in its role as a noise microphone.

In a similar manner to what was discussed in reference to FIG. 1, the communications device 100 still communicates with the communications device 500 via the link 400, transmitting the processed data 139 thereto as part of participating in two-way voice communications. Further, the implementation of one or more transfer functions and the subtractive summation to reduce noise sounds that are detected along with the user's voice sounds are still performed by the processor circuit 150.

However, another difference from the variant of FIG. 1 is the possible addition of another communications device 700 communicating with the communications device 100 via a link 600, and comprising a microphone 710 that may also be employed as a noise microphone to also detect noise sounds in addition to the microphone 310. Where the communications device 700 is present and also involved in detecting environmental noise sounds to further aid in noise reduction, the processor circuit 150 is further caused to receive and store a microphone data 731 specifying one or more characteristics of the microphone 710 via a link 600; to synchronize the clock 151 with a clock 751 of the communications device 700; and/or to recurringly receive and store a detected data 735 comprising data representing noise sounds detected by the microphone 710 in digitized form. The processor circuit 150 is also caused to perform one or more tests on a recurring basis to determine the distance between the microphones 110 and 710, and to update that distances in a distance data 733 stored in the storage 160.

Yet further, in the variant of the voice communications system 1000 of FIG. 3, the communications device 100 may further comprise a second microphone 111 disposed on a casing of the communications device 100 at a different location from the microphone 110, possibly on an opposite side of such a casing from the microphone 110. Where the microphone 111 is present, the communications system 1000 may also use the microphone 111 to detect noise sounds for use in noise reduction. However, it may be, depending on the type and positioning of the microphone 111, that the microphone 111 is simply not used, at all, while the microphone 110 is used in voice communications due to the relatively small distance between the microphones 110 and 111 resulting in the microphone 111 detecting too much of the user's voice sounds.

Figure 4:
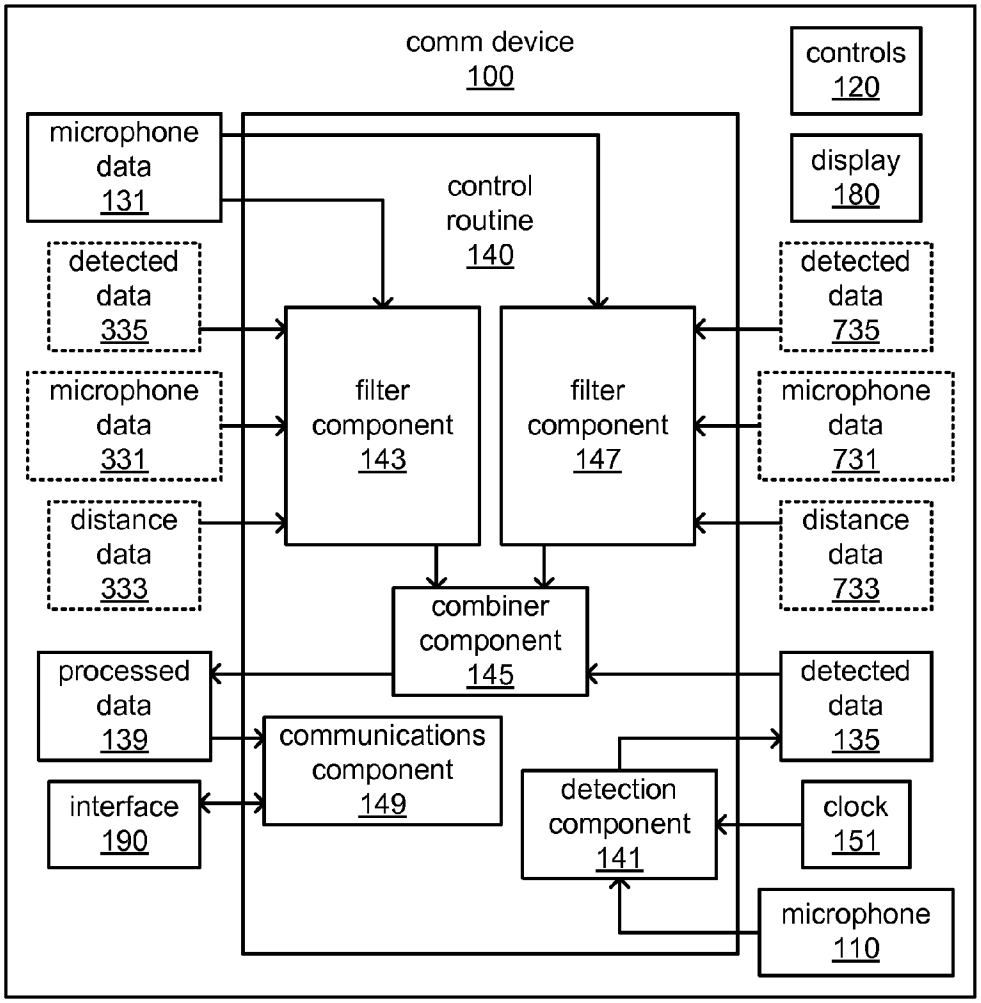
FIG. 4 illustrates a portion of the embodiment of FIG. 3.

FIG. 4 illustrates a block diagram of a portion of the block diagram of FIG. 3 in greater detail. More specifically, aspects of the operating environment of the communications devices 100 in which the processor circuit 150 (shown in FIG. 3) is caused by execution of the control routine 140 to perform the aforedescribed functions are depicted. As will be recognized by those skilled in the art, in the communications device 100, the control routine 140, including the components of which it is composed, are selected to be operative on whatever type of processor or processors are selected to implement the processor circuit 150.

Across both variants of the voice communications system 1000 of FIGS. 1 and 3, most aspects of the communications device 300 remain substantially the same. In contrast, there are substantial differences between the variant of the communications device 100 depicted in FIG. 2 (and associated with the voice communications system 1000 of FIG. 1) and the variant of the communications device 100 depicted in FIG. 4 (and associated with the voice communications system 1000 of FIG. 3).

While the control routine 140 of this variant of FIG. 4 also comprises the detection component 141, the fact that the microphone 110 is employed as the voice microphone to detect voice sounds for voice communications (instead of the microphone 310) results in the detected data 135 being provided directly to the combiner component 145. Again, any of a variety of appropriate analog-to-digital conversion technologies to convert the analog output of the microphone 110 into digitized data that is buffered as the detected data 135 may be employed.

While the control routine 140 of this variant of FIG. 4 also comprises the filter component 143, it is employed to subject the detected data 335 representing noise sounds detected by the microphone 310 (instead of the detected data 135 representing noise sounds detected by the microphone 110) to a transfer function derived by the processor circuit 150 to alter amplitude, phase and/or other characteristics of the noise sounds detected by the microphone 310. This transfer function is derived based on one or more of the microphone data 131, the microphone data 331 and the distance data 333.

Further, in this variant of FIG. 4, if the communications device 700 is present, the control routine 140 further comprises another filter component 147 employed to subject the detected data 735 representing noise sounds detected by the microphone 710 to a transfer function derived by the processor circuit 150 to alter amplitude, phase and/or other characteristics of the noise sounds detected by the microphone 710. This transfer function is derived based on one or more of the microphone data 131, the microphone data 731 and the distance data 733. Not unlike the microphone data 331, the microphone data 731 may be provided either at a time when the communications devices 100 and 700 are configured to form the link 600 and to communicate with each other via the link 600, or may be provided in response to instances of these communications devices being used together as described herein for voice communications. Also not unlike the distance data 333, the distance data 733 may be derived by cooperation between the processor circuits 150 and 750 to recurringly determine the distance between the microphones 110 and 710. Further, not unlike the clock 351, the clock 751 may be synchronized with the clock 151 at a time prior to voice communications to similarly enable timestamping of the detected data 735.

While the control routine 140 of the variant of FIG. 4 also comprises the combiner component 145, it is employed to subtractively sum the detected data 135; the detected data 335, as altered by the filter component 143; and the detected data 735, as altered by the filter component 147, to derive the processed data 139. In so doing, noise sounds detected by the microphone 110 along with voice sounds of the user are reduced using the noise sounds detected by both of the microphones 310 and 710, as altered by the transfer functions implemented by the filter components 143 and 147, respectively.

In one example of the voice communications system 1000 of FIG. 3, the communications device 100 is a telephone (either cellular or corded), the communications device 300 is a wireless headset accessory of the communications device 100, and the communications device 700 is a portable computer system (e.g., a notebook or tablet computer) equipped with audio features enabling its use in voice communications, all three of which are in the possession of a common user. At an earlier time, this user put these three communications devices through pairing procedures to configure them to establish formation of the links 200 and 600 among them and to wirelessly communicate with each other via those links.

Upon arriving at a picnic table in a park, the user sets the communications device 700 on the picnic table, operates the controls 120 of the communications device 100 to dial a phone number and uses the communications device 100 to participate in two-way voice communications with the person associated with that phone number, all while leaving the communications device 300 in a shirt pocket. While the phone call is underway, the user paces about in the general vicinity of the picnic table, getting closer to and further away from it at various times, and thereby repeatedly altering the distance between the microphones 110 and 710. However, with the communications device 300 sitting in a shirt pocket on the user's person, the distance between the microphones 110 and 310 does not vary to much of a degree as the user paces about.

With the microphone 110 employed as the primary microphone for detecting the user's voice, the microphones 310 and 710 are employed in detecting noise sounds in the environment in which all three of these communications devices currently exist. Thus, noise sounds detected by the microphones 310 and 710 are employed, as has been described at length, to reduce the noise sounds from that have been detected by the microphone 110 so that the user's voice as transmitted to the communications device 500 is easier to hear as it is accompanied with less in the way of noise sounds.

However, in pacing about, as the user walks further away from the picnic table, the noise sounds detected by the microphone 710 start to differ to a greater degree from the noise sounds detected by the microphone 110. In anticipation of such situations, the communications device 100 cooperates with each of the communications devices 300 and 700 to recurringly determine the distance between the microphones 110 and 310, and between the microphones 110 and 710. The communications device 100 then adjusts weightings applied to the noise sounds detected by the microphones 310 and 710, accordingly. As the user paces away from the picnic table, the increased distance between the microphones 110 and 710 is detected and the sounds detected by the microphone 710 are relied upon to a lesser degree in reducing the noise sounds detected by the microphone 110. In contrast, the fact of the communications device 300 being carried (in a shirt pocket) with the user along with the communications device 100 has resulted in the distance between the microphones 110 and 310 remaining consistently relatively short such that the noise sounds detected by the microphone 310 are consistently relied upon to a higher degree.

Figure 5:
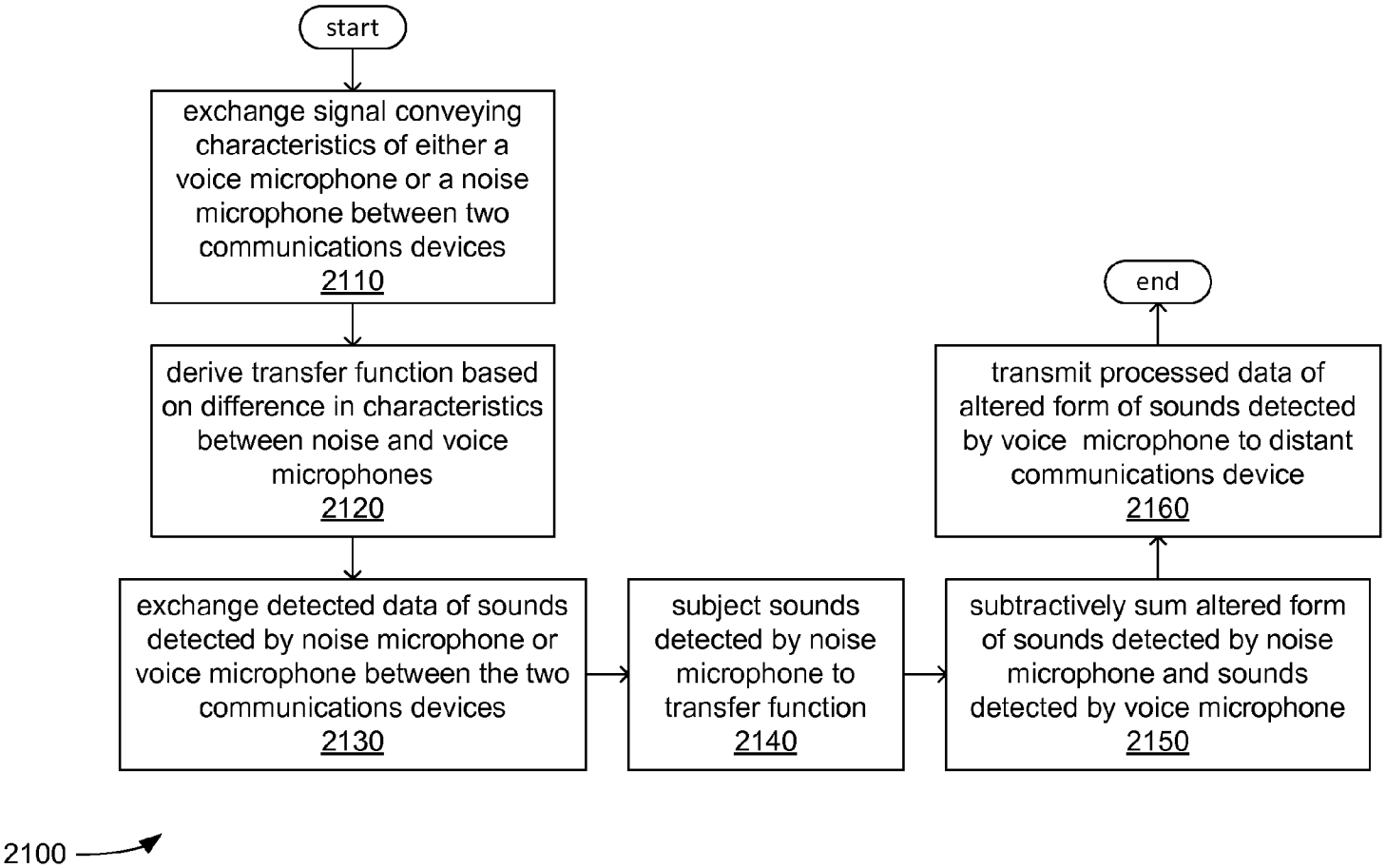
FIG. 5 illustrates an embodiment of a first logic flow.

FIG. 5 illustrates one embodiment of a logic flow 2100. The logic flow 2100 may be representative of some or all of the operations executed by one or more embodiments described herein. More specifically, the logic flow 2100 may illustrate operations performed by the processing circuit 150 of the communications device 100 in executing at least the control routine 140.

At 2110, one communications device (e.g., the communications device 100) receives a signal conveying characteristics of a voice microphone or a noise microphone (e.g., the microphone 310) from another communications device (e.g., the communications device 300). As has been discussed, such characteristics may include details of frequency response, limits of a range of frequencies, etc.

At 2120, the one communications device derives a transfer function based, at least in part, on differences in the characteristics of the voice and noise microphones.

At 2130, the one communications device receives from the other communications device detected data representing either voice sounds detected by the voice microphone or noise sounds detected by the noise microphone.

At 2140, the one communications device subjects the noise sounds to the transfer function. As has been discussed, any of various forms of digital filtering or other digital signal processing may be employed to implement the requisite transfer function(s).

At 2150, the noise sounds, as altered by the transfer function, are subtractively summed by the one communications device with the voice sounds, storing the results of this subtractive summation as a processed data that is transmitted to a distant communications device at 2160.

Figure 6:
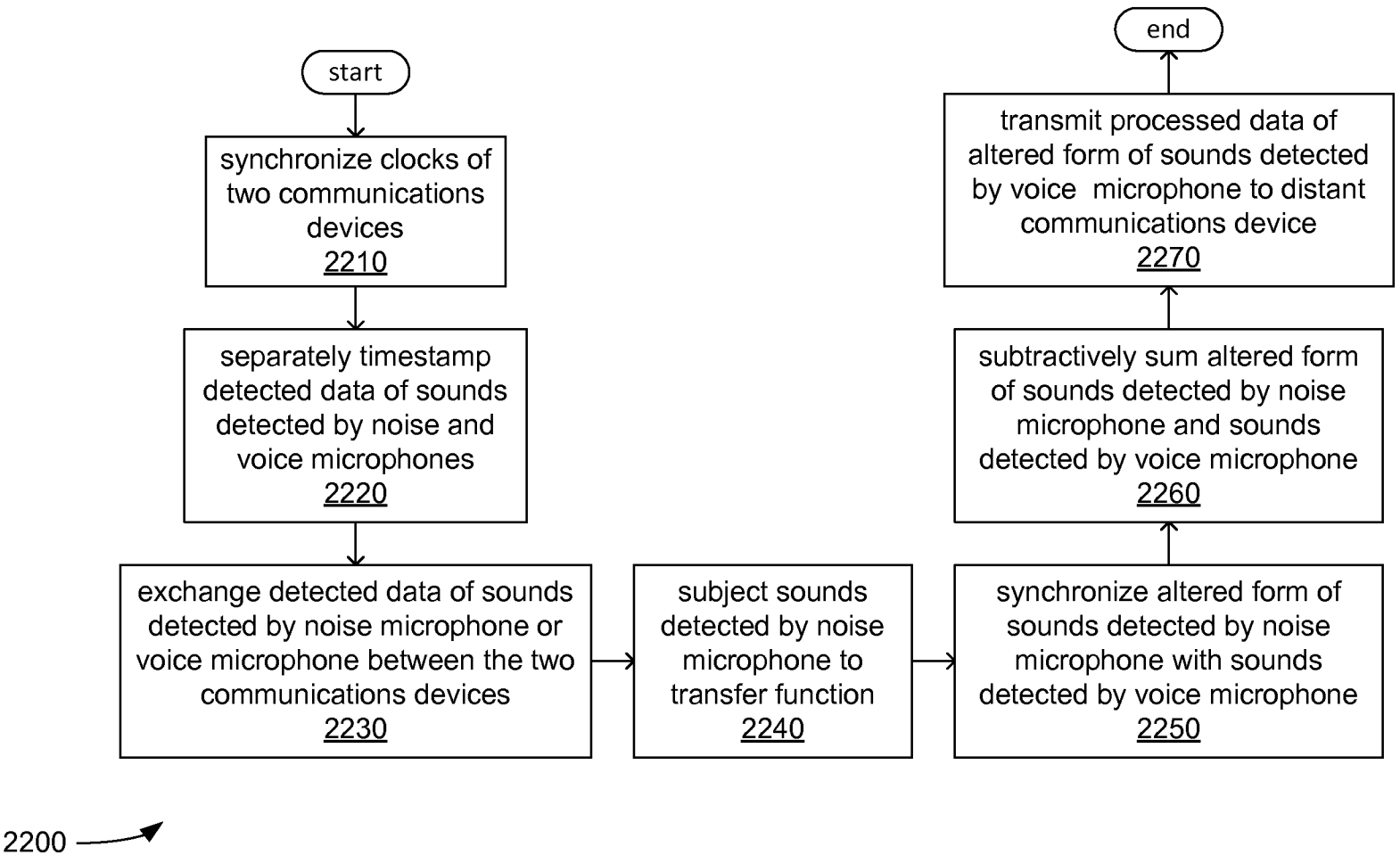
FIG. 6 illustrates an embodiment of a second logic flow.

FIG. 6 illustrates one embodiment of a logic flow 2200. The logic flow 2200 may be representative of some or all of the operations executed by one or more embodiments described herein. More specifically, the logic flow 2200 may illustrate operations performed by the processing circuits 150 and 350 of the communications devices 100 and 300 in executing at least the control routines 140 and 340, respectively.

At 2210, one communications device (e.g., one of the communications devices 100 and 300) synchronizes its clock with the clock of another communications device (e.g., the other of the communications devices 100 and 300).

At 2220, each of the two communications devices separately timestamps detected data representing one of voice sounds detected by a voice microphone and noise sounds detected by a noise microphone. As has been discussed, timestamping of the detected data representing sounds detected by microphones in digital form may be employed to overcome latencies in communications between communications devices by enabling voice and noise sounds to be matched and chronologically aligned by their timestamps.

At 2230, the one communications device receives from the other communications device detected data representing either voice sounds detected by the voice microphone or noise sounds detected by the noise microphone.

At 2240, the one communications device subjects the noise sounds to the transfer function.

At 2250, the noise sounds, as altered by the transfer function, are synchronized by the one communications device with the voice sounds.

At 2260, the noise sounds, as altered by the transfer function, are subtractively summed by the one communications device with the voice sounds, storing the results of this subtractive summation as a processed data that is transmitted to a distant communications device at 2270.

Figure 7:
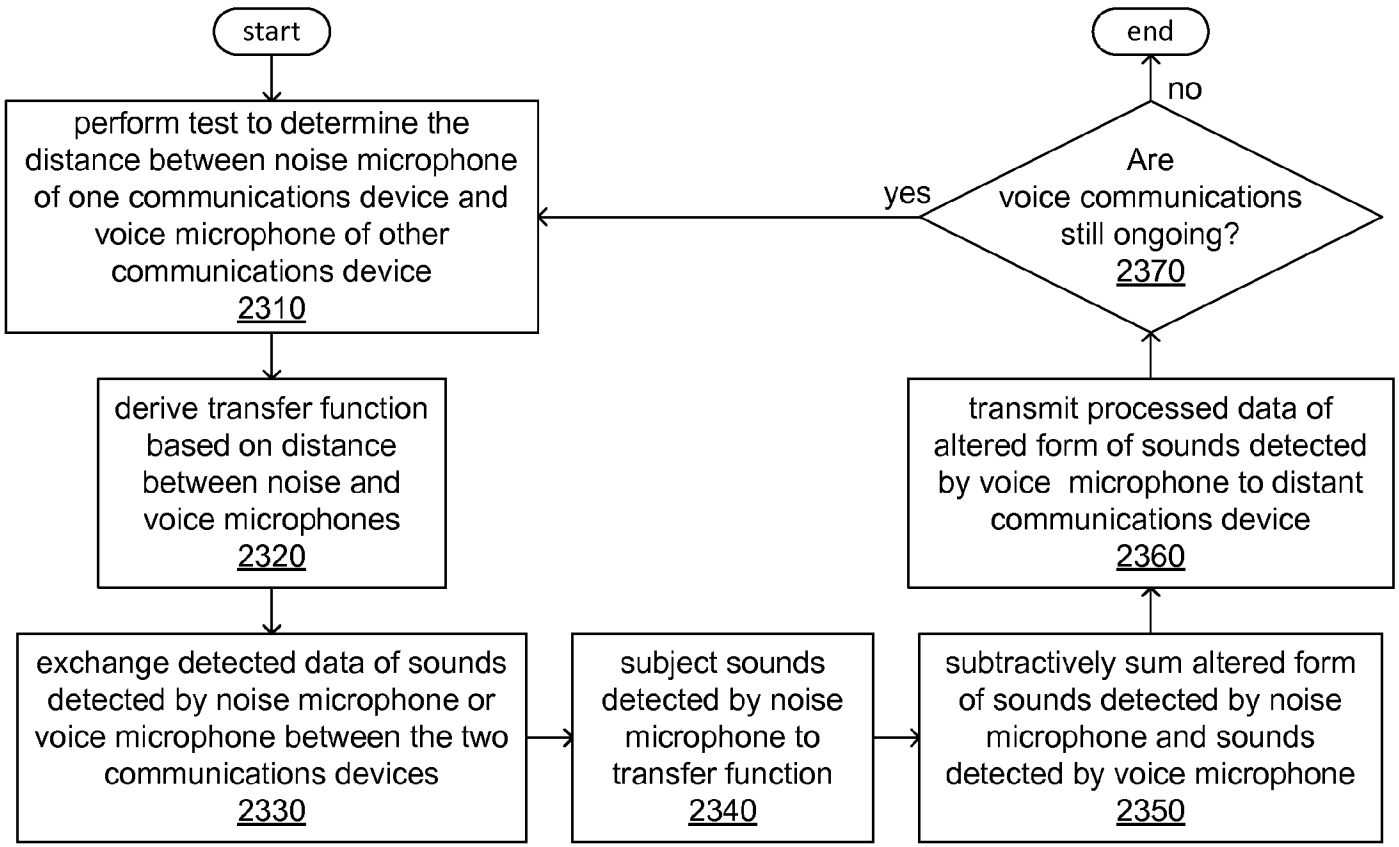
FIG. 7 illustrates an embodiment of a third logic flow.

FIG. 7 illustrates one embodiment of a logic flow 2300. The logic flow 2300 may be representative of some or all of the operations executed by one or more embodiments described herein. More specifically, the logic flow 2300 may illustrate operations performed by the processing circuits 150 and 350 of the communications devices 100 and 300 in executing at least the control routines 140 and 340, respectively.

At 2310, one communications device (e.g., the communications device 100) performs a test to determine the distance between a noise microphone and a voice microphone (e.g., one each of the microphones 110 and 310), one of which is associated with the one communications device, and the other of which is associated with another communications device (e.g., the communications device 300). As has been discussed, various techniques involving tests of signal strength in wireless communications may be used, and/or the emission and detection of a test sound may be used.

At 2320, the one communications device derives a transfer function based, at least in part, on differences in the characteristics of the voice and noise microphones. As has been discussed, distance between microphones may be significant in adjusting phase alignment of sounds in effecting noise reduction, and may be significant in determining the degree to which particular noise sounds should be employed in noise reduction.

At 2330, the one communications device receives from the other communications device detected data representing either voice sounds detected by the voice microphone or noise sounds detected by the noise microphone.

At 2340, the one communications device subjects the noise sounds to the transfer function.

At 2350, the noise sounds, as altered by the transfer function, are subtractively summed by the one communications device with the voice sounds, storing the results of this subtractive summation as a processed data that is transmitted to a distant communications device at 2360.

At 2370, a check is made as to whether voice communications are still ongoing. If yes, then a test to determine the distance between the noise and voice microphones are performed again at 2310.

Figure 8:
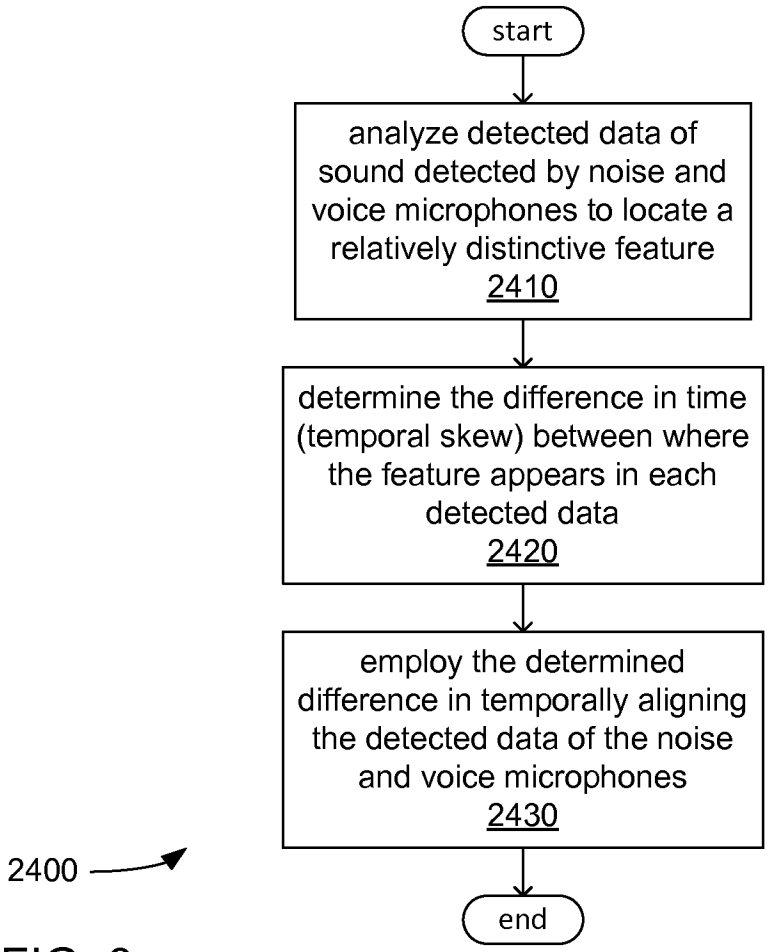
FIG. 8 illustrates an embodiment of a fourth logic flow.

FIG. 8 illustrates one embodiment of a logic flow 2400. The logic flow 2400 may be representative of some or all of the operations executed by one or more embodiments described herein. More specifically, the logic flow 2400 may illustrate operations performed by the processing circuits 150 and 350 of the communications devices 100 and 300 in executing at least the control routines 140 and 340, respectively.

At 2410, one communications device (e.g., one of the communications devices 100 and 300) analyzes the detected data representing voice sounds detected by a voice microphone and detected data representing noise sounds detected by a noise microphone to locate a relatively distinct acoustic feature in both sounds. As previously discussed, this distinct acoustic feature may be generated by one of the communications devices in the form of a test tone—thereby providing an acoustic feature with at least some known characteristics (e.g., a frequency).

At 2420, the communications device determines the difference in time (temporal skew) between when the acoustic feature occurs in each of the detected data.

At 2430, the communications device employs this temporal skew to temporally align the detected data of each of the noise microphone with the detected data of the voice microphone.

Figure 9:
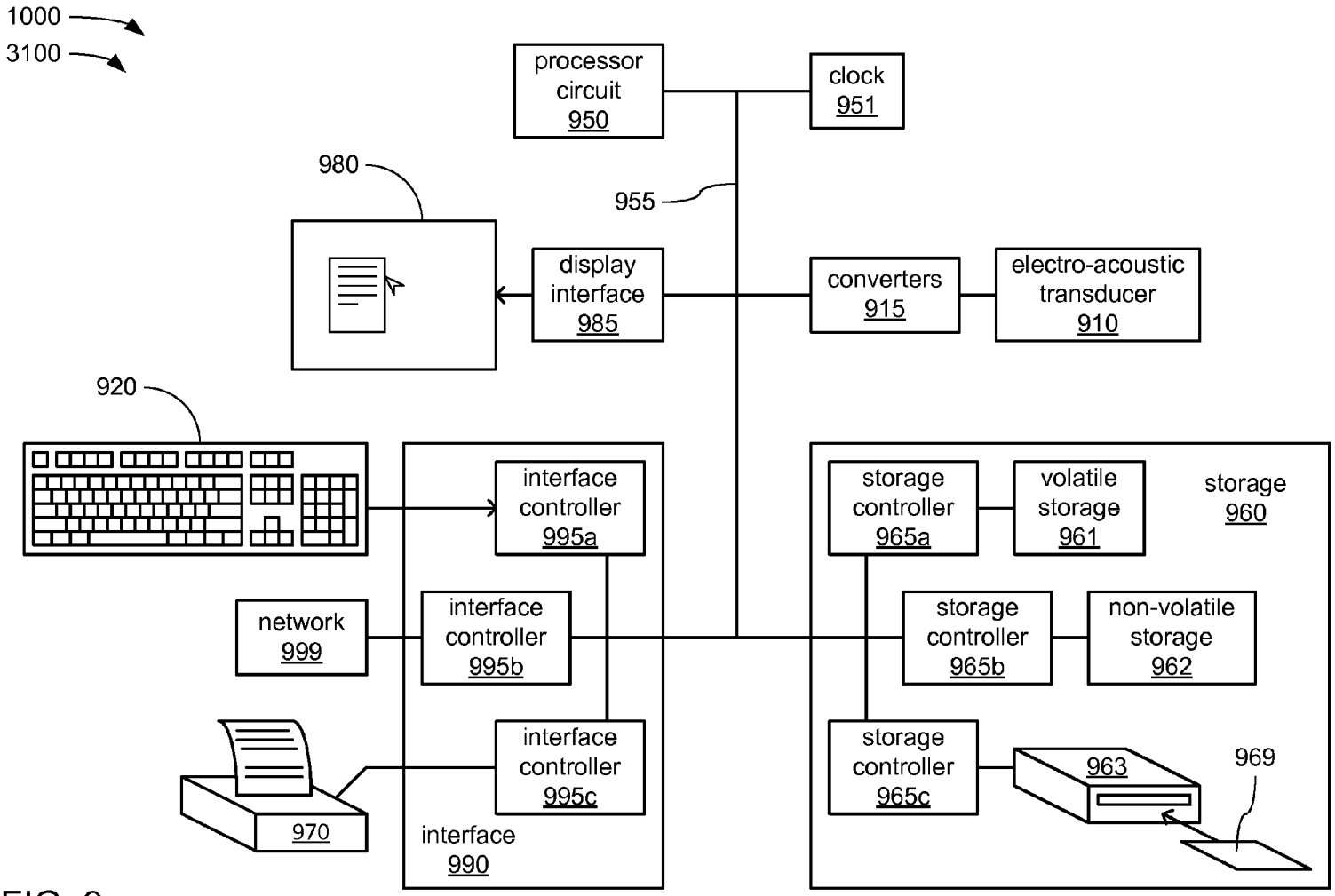
FIG. 9 illustrates an embodiment of a processing architecture.

FIG. 9 illustrates an embodiment of an exemplary processing architecture 3100 suitable for implementing various embodiments as previously described. More specifically, the processing architecture 3100 (or variants thereof) may be implemented as part of one or more of the computing devices 100, 300 and 700. It should be noted that components of the processing architecture 3100 are given reference numbers in which the last two digits correspond to the last two digits of reference numbers of components earlier depicted and described as part of each of the computing devices 100, 300 and 700. This is done as an aid to correlating such components of whichever ones of the computing devices 100, 300 or 700 may employ this exemplary processing architecture in various embodiments.

The processing architecture 3100 includes various elements commonly employed in digital processing, including without limitation, one or more processors, multi-core processors, co-processors, memory units, chipsets, controllers, peripherals, interfaces, oscillators, timing devices, video cards, audio cards, multimedia input/output (I/O) components, power supplies, etc. As used in this application, the terms "system" and "component" are intended to refer to an entity of a computing device in which digital processing is carried out, that entity being hardware, a combination of hardware and software, software, or software in execution, examples of which are provided by this depicted exemplary processing architecture. For example, a component can be, but is not limited to being, a process running on a processor circuit, the processor circuit itself, a storage device (e.g., a hard disk drive, multiple storage drives in an array, etc.) that may employ an optical and/or magnetic storage medium, an software object, an executable sequence of instructions, a thread of execution, a program, and/or an entire computing device (e.g., an entire computer). By way of illustration, both an application running on a server and the server can be a component. One or more components can reside within a process and/or thread of execution, and a component can be localized on one computing device and/or distributed between two or more computing devices. Further, components may be communicatively coupled to each other by various types of communications media to coordinate operations. The coordination may involve the uni-directional or bi-directional exchange of information. For instance, the components may communicate information in the form of signals communicated over the communications media. The information can be implemented as signals allocated to one or more signal lines. Each message may be a signal or a plurality of signals transmitted either serially or substantially in parallel.

As depicted, in implementing the processing architecture 3100, a computing device comprises at least a processor circuit 950, a storage 960, an interface 990 to other devices, and coupling 955. As will be explained, depending on various aspects of a computing device implementing the processing architecture 3100, including its intended use and/or conditions of use, such a computing device may further comprise additional components, such as without limitation, a display interface 985, a clock 951 and/or converters 915.

The coupling 955 is comprised of one or more buses, point-to-point interconnects, transceivers, buffers, crosspoint switches, and/or other conductors and/or logic that communicatively couples at least the processor circuit 950 to the storage 960. The coupling 955 may further couple the processor circuit 950 to one or more of the interface 990 and the display interface 985 (depending on which of these and/or other components are also present). With the processor circuit 950 being so coupled by couplings 955, the processor circuit 950 is able to perform the various ones of the tasks described at length, above, for whichever ones of the computing devices 100, 300 or 700 implement the processing architecture 3100. The coupling 955 may be implemented with any of a variety of technologies or combinations of technologies by which signals are optically and/or electrically conveyed. Further, at least portions of couplings 955 may employ timings and/or protocols conforming to any of a wide variety of industry standards, including without limitation, Accelerated Graphics Port (AGP), CardBus, Extended Industry Standard Architecture (E-ISA), Micro Channel Architecture (MCA), NuBus, Peripheral Component Interconnect (Extended) (PCI-X), PCI Express (PCI-E), Personal Computer Memory Card International Association (PCMCIA) bus, HyperTransport™, QuickPath, and the like.

As previously discussed, the processor circuit 950 (corresponding to one or more of the processor circuits 150, 350 or 750) may comprise any of a wide variety of commercially available processors, employing any of a wide variety of technologies and implemented with one or more cores physically combined in any of a number of ways.

As previously discussed, the clock 951 (corresponding to one or more of the clocks 151, 351 and 751) may be based on any of a variety of timekeeping technologies, including analog and/or digital electronics, such as an oscillator, a phase-locked loop (PLL), etc. However, where a computing device serves in the role of a time server, the clock 951 may be an atomic clock or other highly precise clock maintained by an entity such as a government agency.

As previously discussed, the storage 960 (corresponding to one or more of the storages 160, 360 or 760) may comprise one or more distinct storage devices based on any of a wide variety of technologies or combinations of technologies. More specifically, as depicted, the storage 960 may comprise one or more of a volatile storage 961 (e.g., solid state storage based on one or more forms of RAM technology), a non-volatile storage 962 (e.g., solid state, ferromagnetic or other storage not requiring a constant provision of electric power to preserve their contents), and a removable media storage 963 (e.g., removable disc or solid state memory card storage by which information may be conveyed between computing devices). This depiction of the storage 960 as possibly comprising multiple distinct types of storage is in recognition of the commonplace use of more than one type of storage device in computing devices in which one type provides relatively rapid reading and writing capabilities enabling more rapid manipulation of data by the processor circuit 950 (but possibly using a "volatile" technology constantly requiring electric power) while another type provides relatively high density of non-volatile storage (but likely provides relatively slow reading and writing capabilities).

Given the often different characteristics of different storage devices employing different technologies, it is also commonplace for such different storage devices to be coupled to other portions of a computing device through different storage controllers coupled to their differing storage devices through different interfaces. By way of example, where the volatile storage 961 is present and is based on RAM technology, the volatile storage 961 may be communicatively coupled to coupling 955 through a storage controller 965*a* providing an appropriate interface to the volatile storage 961 that perhaps employs row and column addressing, and where the storage controller 965*a* may perform row refreshing and/or other maintenance tasks to aid in preserving information stored within the volatile storage 961. By way of another example, where the non-volatile storage 962 is present and comprises one or more ferromagnetic and/or solid-state disk drives, the non-volatile storage 962 may be communicatively coupled to coupling 955 through a storage controller 965*b* providing an appropriate interface to the non-volatile storage 962 that perhaps employs addressing of blocks of information and/or of cylinders and sectors. By way of still another example, where the removable media storage 963 is present and comprises one or more optical and/or solid-state disk drives employing one or more pieces of machine-readable storage media 969, the removable media storage 963 may be communicatively coupled to coupling 955 through a storage controller 965*c* providing an appropriate interface to the removable media storage 963 that perhaps employs addressing of blocks of information, and where the storage controller 965*c* may coordinate read, erase and write operations in a manner specific to extending the lifespan of the machine-readable storage media 969.

One or the other of the volatile storage 961 or the non-volatile storage 962 may comprise an article of manufacture in the form of a machine-readable storage media on which a routine comprising a sequence of instructions executable by the processor circuit 950 may be stored, depending on the technologies on which each is based. By way of example, where the non-volatile storage 962 comprises ferromagnetic-based disk drives (e.g., so-called "hard drives"), each such disk drive typically employs one or more rotating platters on which a coating of magnetically responsive particles is deposited and magnetically oriented in various patterns to store information, such as a sequence of instructions, in a manner akin to removable storage media such as a floppy diskette. By way of another example, the non-volatile storage 962 may comprise banks of solid-state storage devices to store information, such as sequences of instructions, in a manner akin to a compact flash card. Again, it is commonplace to employ differing types of storage devices in a computing device at different times to store executable routines and/or data. Thus, a routine comprising a sequence of instructions to be executed by the processor circuit 950 may initially be stored on the machine-readable storage media 969, and the removable media storage 963 may be subsequently employed in copying that routine to the non-volatile storage 962 for longer term storage not requiring the continuing presence of the machine-readable storage media 969 and/or the volatile storage 961 to enable more rapid access by the processor circuit 950 as that routine is executed.

As previously discussed, the interface 990 (corresponding to one or more of the interfaces 190, 390 and 790) may employ any of a variety of signaling technologies corresponding to any of a variety of communications technologies that may be employed to communicatively couple a computing device to one or more other devices. Again, one or both of various forms of wired or wireless signaling may be employed to enable the processor circuit 950 to interact with input/output devices (e.g., the depicted example keyboard 920 or printer 970) and/or other computing devices, possibly through a network (e.g., the network 999) or an interconnected set of networks. In recognition of the often greatly different character of multiple types of signaling and/or protocols that must often be supported by any one computing device, the interface 990 is depicted as comprising multiple different interface controllers 995*a*, 995*b* and 995*c*. The interface controller 995*a* may employ any of a variety of types of wired digital serial interface or radio frequency wireless interface to receive serially transmitted messages from user input devices, such as the depicted keyboard 920 (possibly corresponding to the controls 120, 320 or 720). The interface controller 995*b* may employ any of a variety of cabling-based or wireless signaling, timings and/or protocols to access other computing devices through the depicted network 999 (possibly a network comprising one or more links, such as the links 200, 400 or 600; smaller networks; or the Internet). The interface 995*c* may employ any of a variety of electrically conductive cabling enabling the use of either serial or parallel signal transmission to convey data to the depicted printer 970. Other examples of devices that may be communicatively coupled through one or more interface controllers of the interface 990 include, without limitation, microphones, remote controls, stylus pens, card readers, finger print readers, virtual reality interaction gloves, graphical input tablets, joysticks, other keyboards, retina scanners, the touch input component of touch screens, trackballs, various sensors, laser printers, inkjet printers, mechanical robots, milling machines, etc.

Where a computing device is communicatively coupled to (or perhaps, actually comprises) a display (e.g., the depicted example display 980, corresponding to the display 180), such a computing device implementing the processing architecture 3100 may also comprise the display interface 985. Although more generalized types of interface may be employed in communicatively coupling to a display, the somewhat specialized additional processing often required in visually displaying various forms of content on a display, as well as the somewhat specialized nature of the cabling-based interfaces used, often makes the provision of a distinct display interface desirable. Wired and/or wireless signaling technologies that may be employed by the display interface 985 in a communicative coupling of the display 980 may make use of signaling and/or protocols that conform to any of a variety of industry standards, including without limitation, any of a variety of analog video interfaces, Digital Video Interface (DVI), DisplayPort, etc.

Where a computing device is communicatively coupled to (or perhaps, actually comprises) one or more electro-acoustic transducers (e.g., the depicted example electro-acoustic transducer 910, corresponding to the microphones 110, 310 and 710), such a computing device implementing the processing architecture 3100 may also comprise the converters 915. The electro-acoustic transducer may any of a variety of devices converting between electrical and acoustic forms of energy, including and not limited to, microphones, speakers, mechanical buzzers, piezoelectric elements, actuators controlling airflow through resonant structures (e.g., horns, whistles, pipes of an organ, etc.). The converters 915 may comprise any of a variety of circuitry converting between electrical signals of different characteristics, such as without limitation, power transistors, electronic switches, voltage converters, digital-to-analog converters, analog-to-digital converters, etc.

More generally, the various elements of the computing devices 100, 300 and 700 may comprise various hardware elements, software elements, or a combination of both. Examples of hardware elements may include devices, logic devices, components, processors, microprocessors, circuits, processor circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), memory units, logic gates, registers, semiconductor device, chips, microchips, chip sets, and so forth. Examples of software elements may include software components, programs, applications, computer programs, application programs, system programs, software development programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. However, determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints, as desired for a given implementation.

Some embodiments may be described using the expression "one embodiment" or "an embodiment" along with their derivatives. These terms mean that a particular feature, structure, or characteristic described in connection with the embodiment is included in at least one embodiment. The appearances of the phrase "in one embodiment" in various places in the specification are not necessarily all referring to the same embodiment. Further, some embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

It is emphasized that the Abstract of the Disclosure is provided to allow a reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. The detailed disclosure now turns to providing examples that pertain to further embodiments. The examples provided below are not intended to be limiting.

An example of a first communications device comprises a processor circuit; a first microphone; an interface operative to communicatively couple the processor circuit to a network; and a storage communicatively coupled to the processor circuit and arranged to store a sequence of instructions. The sequence of instructions is operative on the processor circuit to store a first detected data that represents sounds detected by the first microphone; receive a second detected data via the network that represents sounds detected by a second microphone of a second communications device; subtractively sum the first and second data to create a processed data; and transmit the processed data to a third communications device.

The above example of a first communications device comprises a first clock, and in which the instructions are operative on the processor circuit to signal the second communications device to synchronize the first clock with a second clock of the second communications device; timestamp the first detected data with a time maintained by the first clock; and align timestamps of the first and second detected data.

Either of the above examples of a first communications device in which the instructions are operative on the processor circuit to locate occurrences of an acoustic feature in both the first and second detected data; determine a difference in time of occurrence of the acoustic feature in the first detected data and in the second detected data; and align the first and second detected data based on the difference in time.

Any of the above examples of a first communications device in which the instructions are operative on the processor circuit to determine a distance between the first and second microphones; and employ the distance between the first and second microphones as a weighting factor in subtractively summing the first and the second detected data.

Any of the above examples of a first communications device in which the instructions are operative on the processor circuit to subject a one of the first and second detected data that represents noise sounds to a transfer function prior to subtractively summing the first and second detected data.

Any of the above examples of a first communications device in which the instructions are operative on the processor circuit to operate the interface to vary a signal strength of signals transmitted to the second communications device via the network to detect a distance between the first and second microphones; and derive the transfer function based at least on the distance between the first and second microphones.

Any of the above examples of a first communications device in which the instructions operative on the processor circuit to operate an acoustic transducer of the first communications device to generate a test sound; receive a signal from the second communications device via the network that indicates a time at which the second microphone detected the test sound; determine a distance between the first and second microphones based on the time at which the second microphone detected the test sound; and derive the transfer function based at least on the distance between the first and second microphones.

Any of the above examples of a first communications device in which the instructions operative on the processor circuit to determine a distance between the first and second microphones; and alter the transfer function based on the distance between the first and second microphones.

Any of the above examples of a first communications device in which the instructions operative on the processor circuit to receive a signal via the network from the second communications device that specifies a characteristic of the second microphone; and derive the transfer function based on a difference in characteristics between the first and second microphones.

Any of the above examples of a first communications device in which the characteristic comprises microphone frequency response.

An example of an apparatus comprises a processor circuit; a first clock; a first microphone; an interface operative to communicatively couple the processor circuit to a network; and a storage communicatively coupled to the processor circuit and arranged to store a sequence of instructions. The instructions are operative on the processor circuit to convert signals output by the first microphone into a detected data that represents sounds detected by the first microphone; receive a signal via the network from a communications device that requests synchronization of the first clock with a second clock of the communications device; synchronize the first and second clocks in response to the request; timestamp the detected data with a time maintained by the first clock; and transmit the detected data with timestamp via the network to the communications device.

The above example of an apparatus in which the instructions are operative on the processor circuit to detect with the first microphone a test signal emitted by the communications device; and transmit a time at which the first microphone detected the test signal via the network to the communications device.

Either of the above examples of an apparatus in which the instructions are operative on the processor circuit to receive a signal via the network from the communications device that requests a microphone data that specifies a characteristic of the first microphone; and transmit the microphone data to the communications device.

Any of the above examples of an apparatus in which the characteristic comprises a frequency response of the first microphone.

An example of a computer-implemented method comprises storing a first detected data representing sounds detected by a first microphone of a first communications device; receiving a second detected data via a network from a second communications device representing sounds detected by a second microphone of the second communications device; receiving a signal specifying a characteristic of the second microphone; deriving a transfer function based at least on a difference in characteristics between the first and second microphones; subjecting a one of the first and second detected data representing noise sounds to the transfer function; subtractively summing the first and second detected data, resulting in processed data; and transmitting the processed data to a third communications device.

The above example of a computer-implemented method in which the characteristic comprises microphone frequency response.

Either of the above examples of a computer-implemented method comprises signaling the second communications device to synchronize a first clock of the first communications device with a second clock of the second communications device; timestamping the first detected data with a time maintained by the first clock; and aligning timestamps of the first and second detected data.

Any of the above examples of a computer-implemented method comprises locating occurrences of an acoustic feature in both the first and second detected data; determining a difference in time of occurrence of the acoustic feature in the first detected data and in the second detected data; and aligning the first and second detected data based on the difference in time.

Any of the above examples of a computer-implemented method comprises varying a signal strength of signals transmitted to the second communications device via the network to detect a distance between the first and second microphones; and altering the transfer function based at least on the distance between the first and second microphones.

Any of the above examples of a computer-implemented method comprises generating a test sound; receiving a signal from the second communications device via the network indicating a time at which the second microphone detected the test sound; determining a distance between the first and second microphones based on the time at which the second microphone detected the test sound; and altering the transfer function based at least on the distance between the first and second microphones.

Any of the above examples of a computer-implemented method comprises determining a distance between the first and second microphones; and employing the distance between the first and second microphones as a weighting factor in subtractively summing the first and the second detected data.

An example of at least one machine-readable storage medium comprises instructions that when executed by a first computing device, causes the first computing device to signal a second computing device via a network to synchronize a first clock of the first computing device with a second clock of the second computing device; convert signals output by a first microphone of the first computing device into a first detected data representing sounds detected by the first microphone; timestamp the first detected data with a time maintained by the first clock; receive a second detected data via the network from the second computing device representing sounds detected by a second microphone of the second computing device; subject a one of the first and second detected data representing noise sounds to a transfer function; align timestamps of the first and second detected data; subtractively sum the first and second detected data, resulting in a processed data; and transmit the processed data to a third computing device.

The above example of at least one machine-readable storage medium in which the first computing device is caused to vary a signal strength of signals transmitted to the second computing device via the network to detect a distance between the first and second microphones; and derive the transfer function based at least on the distance between the first and second microphones.

Either of the above examples of at least one machine-readable storage medium in which the first computing device is caused to generate a test sound; receive a signal from the second computing device via the network indicating a time at which the second microphone detected the test sound; determine a distance between the first and second microphones based on the time at which the second microphone detected the test sound; and derive the transfer function based at least on the distance between the first and second microphones.

Any of the above examples of at least one machine-readable storage medium in which the first computing device is caused to receive a signal via the network from the second computing device specifying a characteristic of the second microphone; and derive the transfer function based at least on a difference in characteristics between the first and second microphones.

Any of the above examples of at least one machine-readable storage medium in which the characteristic comprises microphone frequency response.

Any of the above examples of at least one machine-readable storage medium in which the first computing device is caused to determine a distance between the first and second microphones; and employ the distance between the first and second microphones as a weighting factor in subtractively summing the first and the second detected data.

Any of the above examples of at least one machine-readable storage medium in which the first computing device is caused to determine a distance between the first and second microphones; and alter the transfer function based on the distance between the first and second microphones.

The invention claimed is:

1. A first communications device comprising:

a processor circuit;

a first microphone;

an interface operative to communicatively couple the processor circuit to a network; and a storage communicatively coupled to the processor circuit and arranged to store a sequence of instructions operative on the processor circuit to:

store a first detected data that represents sounds detected by the first microphone;

receive a second detected data via the network that represents sounds detected by a second microphone of a second communications device;

subtractively sum the first and second data to create a processed data; and transmit the processed data to a third communications device.

2. The first communications device of claim 1, comprising a first clock, the instructions operative on the processor circuit to:

signal the second communications device to synchronize the first clock with a second clock of the second communications device;

timestamp the first detected data with a time maintained by the first clock; and align timestamps of the first and second detected data.

3. The first communications device of claim 1, the instructions operative on the processor circuit to:

locate occurrences of an acoustic feature in both the first and second detected data;

determine a difference in time of occurrence of the acoustic feature in the first detected data and in the second detected data; and align the first and second detected data based on the difference in time.

4. The first communications device of claim 1, the instructions operative on the processor circuit to:

determine a distance between the first and second microphones; and employ the distance between the first and second microphones as a weighting factor in subtractively summing the first and the second detected data.

5. The first communications device of claim 1, the instructions operative on the processor circuit to subject a one of the first and second detected data that represents noise sounds to a transfer function prior to subtractively summing the first and second detected data.

6. The first communications device of claim 5, the instructions operative on the processor circuit to:

operate the interface to vary a signal strength of signals transmitted to the second communications device via the network to detect a distance between the first and second microphones; and derive the transfer function based at least on the distance between the first and second microphones.

7. The first communications device of claim 5, the instructions operative on the processor circuit to:

operate an acoustic transducer of the first communications device to generate a test sound;

receive a signal from the second communications device via the network that indicates a time at which the second microphone detected the test sound;

determine a distance between the first and second microphones based on the time at which the second microphone detected the test sound; and derive the transfer function based at least on the distance between the first and second microphones.

8. The first communications device of claim 5, the instructions operative on the processor circuit to:

determine a distance between the first and second microphones; and alter the transfer function based on the distance between the first and second microphones.

9. The first communications device of claim 5, the instructions operative on the processor circuit to:

receive a signal via the network from the second communications device that specifies a characteristic of the second microphone; and derive the transfer function based on a difference in characteristics between the first and second microphones.

10. The first communications device of claim 8, the characteristic comprising microphone frequency response.

11. The first communications device of claim 1, the interface operative to communicatively couple the processor circuit to the network comprises the interface arranged as a wired digital serial interface to couple the processor circuit to the network that includes a wired network.

12. The first communications device of claim 1, the interface operative to communicatively couple the processor circuit to the network comprises the interface arranged as a radio frequency wireless interface to couple the processor circuit to the network that includes a wireless network.

* * * * *